US006497951B1

(12) United States Patent
DeAngelis et al.

(10) Patent No.: US 6,497,951 B1
(45) Date of Patent: Dec. 24, 2002

(54) TEMPERATURE DEPENDENT ELECTRICALLY RESISTIVE YARN

(75) Inventors: Alfred R. DeAngelis; Earle Wolynes, both of Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/667,065

(22) Filed: Sep. 21, 2000

(51) Int. Cl.[7] ..... D01F 6/00; D01F 8/00

(52) U.S. Cl. ..... 428/364; 428/372; 428/370; 428/373

(58) Field of Search ..... 428/370, 373, 428/374, 372, 364

(56) References Cited

U.S. PATENT DOCUMENTS

| | | | | |
|---|---|---|---|---|
| 3,243,753 A | | 3/1966 | Kohler | 338/31 |
| 3,412,358 A | | 11/1968 | Hummel et al. | 338/7 |
| 3,591,526 A | | 7/1971 | Kawashima et al. | 252/511 |
| 4,055,526 A | | 10/1977 | Kiyokawa et al. | 264/22 |
| 4,058,704 A | | 11/1977 | Shimizu | 219/528 |
| 4,061,827 A | | 12/1977 | Gould | 428/368 |
| 4,198,562 A | | 4/1980 | Mills et al. | 219/505 |
| 4,200,973 A | | 5/1980 | Farkas | 29/611 |
| 4,309,596 A | | 1/1982 | Crowley | 219/549 |
| 4,474,825 A | | 10/1984 | Schmidt | 427/10 |
| 4,554,439 A | | 11/1985 | Cross et al. | 219/497 |
| 4,575,620 A | | 3/1986 | Ishii et al. | 219/549 |
| 4,742,212 A | | 5/1988 | Ishii et al. | 219/549 |
| 4,818,439 A | | 4/1989 | Blackledge et al. | 252/511 |
| 4,966,729 A | | 10/1990 | Carmona et al. | 252/511 |
| 4,983,814 A | | 1/1991 | Ohgushi et al. | 219/545 |
| 5,138,133 A | | 8/1992 | Sakurada et al. | 219/211 |
| 5,170,036 A | | 12/1992 | Altmann et al. | 219/217 |
| 5,416,462 A | | 5/1995 | Demarmels et al. | 338/22 |
| 5,451,747 A | | 9/1995 | Sullivan et al. | 219/528 |
| 5,460,883 A | * | 10/1995 | Barber, Jr. et al. | 428/370 |
| 5,484,983 A | | 1/1996 | Roell | 219/545 |
| 5,597,649 A | * | 1/1997 | Sander et al. | 428/370 |
| 5,776,608 A | | 7/1998 | Asher et al. | 428/373 |
| 5,776,609 A | | 7/1998 | McCullough | 428/375 |
| 5,804,291 A | | 9/1998 | Fraser, Jr. | 428/283 |
| 5,824,996 A | | 10/1998 | Kochman et al. | 219/529 |
| 5,861,610 A | | 1/1999 | Weiss | 219/497 |
| 5,916,506 A | | 6/1999 | Breznak et al. | 264/104 |
| 5,952,099 A | * | 9/1999 | Asher et al. | 428/373 |
| 6,172,344 B1 | | 1/2001 | Gordon et al. | 219/529 |
| 6,242,094 B1 | * | 6/2001 | Breznak et al. | 428/374 |
| 6,287,690 B1 | * | 9/2001 | Land | 428/373 |

FOREIGN PATENT DOCUMENTS

| | | |
|---|---|---|
| EP | 0 243 504 | 11/1987 |
| GB | 1417394 | 12/1975 |
| JP | 11 354261 A | 12/1999 |

OTHER PUBLICATIONS

Shakespere Conductive Fibers, LLC; Brochure: "Resistat Conductive Fibers—Engineered for Static Control Solutions"; Believed to be published on Sep. 9, 2001.

European Patent Office; International Search Report for International Application No. PCT/US01/29379; Jul. 8, 2002.

* cited by examiner

*Primary Examiner*—Newton Edwards
(74) *Attorney, Agent, or Firm*—Terry T. Moyer; Jeffery E. Bacon

(57) ABSTRACT

A positive variable resistive yarn having a core, a sheath, and an insulator. The sheath includes distinct electrical conductors intermixed within a thermal expansive low conductive matrix. As the temperature of the yarn increases, the resistance of the sheath increases.

7 Claims, 2 Drawing Sheets

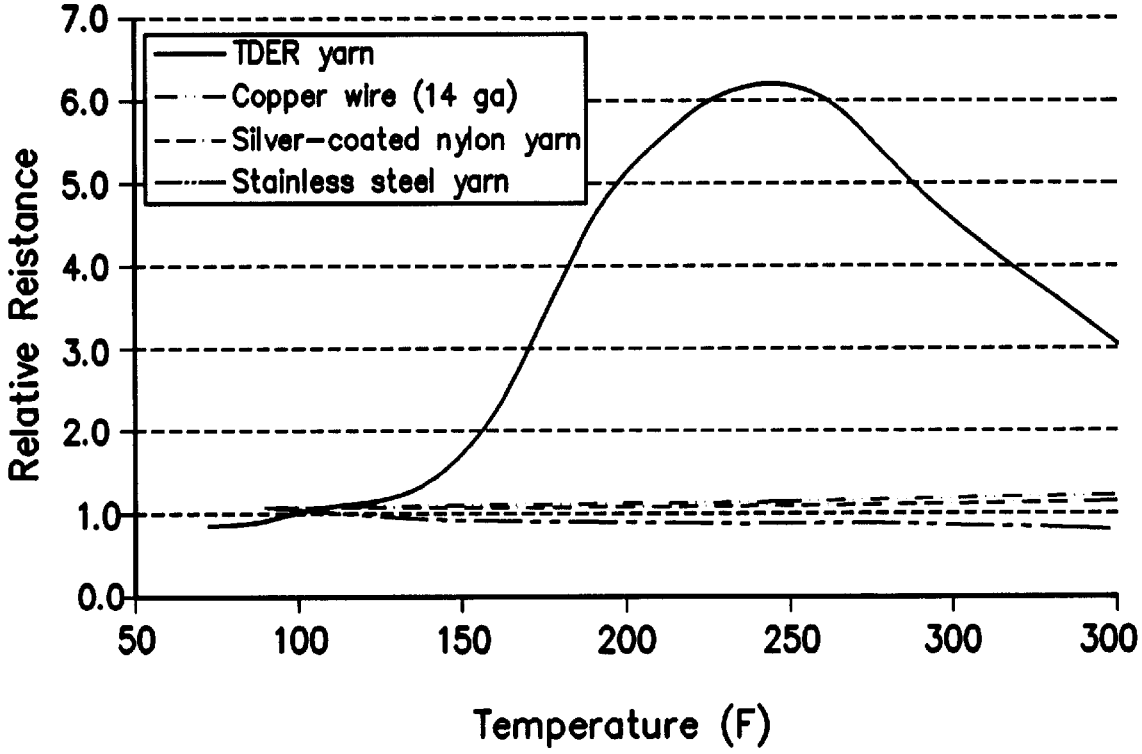
*FIG. —3—*

TEMPERATURE DEPENDENT ELECTRICALLY RESISTIVE YARN

BACKGROUND

The present invention relates generally to electrically conductive yarns, and in particular, to electrically conductive yarns providing a resistance that is variable with temperature.

Electrically conductive elements have been used as heating elements in textiles such as knit or woven fabrics. The electrically conductive elements are incorporated into the textile, and electricity is passed though the electrically conductive elements. Therefore, there is a need for electrically conductive elements, such as yarns for use in items such as textiles.

BRIEF DESCRIPTION OF THE DRAWINGS

FIG. 3 shows a graph illustrating the different temperature dependence of the electrical resistance of one embodiment of a yarn made according to the present invention, and "conventional" conducting materials that might be put into a fabric.

DETAILED DESCRIPTION

Figure 1:
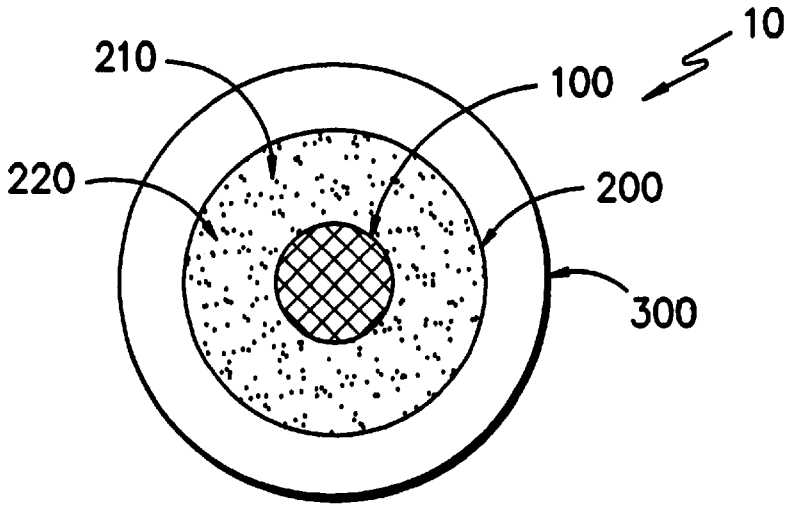
FIG. 1 shows an enlarged cross-sectional view of an embodiment of the present invention, illustrated as a temperature variable resistive yarn.

Referring to FIG. 1, there is shown a temperature dependent electrically resistive yarn 10 illustrating one embodiment of the present invention. The yarn 10 generally comprises a core yarn 100 and a positive temperature coefficient of resistance (PTCR) sheath 200. The yarn 10 can also include an insulator 300 over the PTCR sheath 200. As illustrated, the temperature variable resistive yarn 10 is a circular cross section; however, it is anticipated that the yarn 10 can have other cross sections which are suitable for formation into textiles, such as oval, flat, or the like.

The core yarn 100 is generally any material providing suitable flexibility and strength for a textile yarn. The core yarn 100 can be formed of synthetic yarns such as polyester, nylon, acrylic, rayon, Kevlar, Nomex, glass, or the like, or can be formed of natural fibers such as cotton, wool, silk, flax, or the like. The core yarn 100 can be formed of monofilaments, multifilaments, or staple fibers. Additionally, the core yarn 100 can be flat, spun, or other type yarns that are used in textiles. In one embodiment, the core yarn 100 is a non-conductive material.

The PTCR sheath 200 is a material that provides increased electrical resistance with increased temperature. In the embodiment of the present invention, illustrated in FIG. 1, the sheath 200 generally comprises distinct electrical conductors 210 intermixed within a thermal expansive low conductive (TELC) matrix 220.

The distinct electrical conductors 210 provide the electrically conductive pathway through the PTCR sheath 200. The distinct electrical conductors 210 are preferably particles such as particles of conductive materials, conductive-coated spheres, conductive flakes, conductive fibers, or the like. The conductive particles, fibers, or flakes can be formed of materials such as carbon, graphite, gold, silver, copper, or any other similar conductive material. The coated spheres can be spheres of materials such as glass, ceramic, copper, which are coated with conductive materials such as carbon, graphite, gold, silver, copper or other similar conductive material. The spheres are microspheres, and in one embodiment, the spheres are between about 10 and about 100 microns in diameter.

The TELC matrix 220 has a higher coefficient of expansion than the conductive particles 210. The material of the TELC matrix 220 is selected to expand with temperature, thereby separating various conductive particles 210 within the TELC matrix 220. The separation of the conductive particles 210 increases the electrical resistance of the PTCR sheath 200. The TELC matrix 220 is also flexible to the extent necessary to be incorporated into a yarn. In one embodiment, the TELC matrix 220 is an ethylene ethylacrylate (EEA) or a combination of EEA with polyethylene. Other materials that might meet the requirements for a material used as the TELC matrix 220 include, but are not limited to, polyethylene, polyolefins, halo-derivitaves of polyethylene, thermoplastic, or thermoset materials.

The PTCR sheath 200 can be applied to the core 100 by extruding, coating, or any other method of applying a layer of material to the core yarn 100. Selection of the particular type of distinct electrical conductors 210 (e.g. flakes, fibers, spheres, etc.) can impart different resistance-to-temperature properties, as well as influence the mechanical properties of the PTCR sheath 200. The TELC matrix 220 can be formed to resist or prevent softening or melting at the operating temperatures. It has been determined that useful resistance values for the yarn 10 could vary anywhere within the range of from about 0.1 Ohms/inch to about 2500 Ohms/inch, depending on the desired application.

A description of attributes of a material that could be suitable as the PTCR sheath 200 can also be found in U.S. Pat. No. 3,243,753, issued on Mar. 29, 1966 to Fred Kohler, which is hereby incorporated herein in its entirety by specific reference thereto. A description of attributes of another material that could be suitable as the PTCR sheath 200 can also be found in U.S. Pat. No. 4,818,439, issued on Apr. 4, 1984 to Blackledge et al., which is also hereby incorporated herein in its entirety by specific reference thereto.

One embodiment of the present invention, the TELC matrix 220 can be set by cross-linking the material, for example through radiation, after application to the core yarn 100. In another embodiment, the TELC matrix 220 can be set by using a thermosetting polymer as the TELC matrix 220. In another embodiment, TELC matrix 220 can be left to soften at a specific temperature to provide a built-in "fuse" that will cut off the conductivity of the TELC matrix 220 at the location of the selected temperature.

The insulator 300 is a non-conductive material which is appropriate for the flexibility of a yarn. In one embodiment, the coefficient of expansion is close to the TELC matrix 220. The insulator 300 can be a thermoplastic, thermoset plastic, or a thermoplastic that will change to thermoset upon treatment, such as polyethylene. Materials suitable for the insulator 300 include polyethylene, polyvinylchloride, or the like. The insulator 300 can be applied to the PTCR sheath 200 by extrusion, coating, wrapping, or wrapping and heating the material of the insulator 300.

A voltage applied across the yarn 10 causes a current to flow through the PTCR sheath 200. As the temperature of the yarn 10 increases, the resistance of the PTCR sheath 200 increases. The increase in the resistance of the yarn 10 is obtained by the expansion of the TELC matrix 220 separating conductive particles 210 within the TELC matrix 220, thereby removing the micropaths along the length of the yarn 10 and increasing the total resistance of the PTCR sheath 200. The particular conductivity-to-temperature relationship is tailored to the particular application. For example, the conductivity may increase slowly to a given point, the rise quickly at a cutoff temperature.

The present invention can be further understood by reference to the following examples:

EXAMPLE 1

A temperature dependent electrically resistance yarn was formed from a core yarn of 500 denier multi-filament polyester with a PTCR sheath of fifty percent (50%) carbon conducting particles and fifty percent (50%) EEA. The average yarn size was about 40 mils. with a denier of 8100. Prior to extruding the PTCR sheath onto the core yarn, the material for the PTCR sheath was predried at 165° F. for at least twenty four (24) hours. The yarn was formed by extrusion coating the TELC material onto the core yarn at a temperature of about 430° F. through an orifice of about 47 mils. at a pressure of about 6600 psi. The coated core yarn was quenched in water at a temperature of about 85° F. The resistance of the yarn was about 350 Ohms/inch at about 72° F. The final yarn had a tenacity of about 9.3 lbs and an elongation at breaking of about 12%, giving a stiffness of 4.3 grams/denier %.

EXAMPLE 2

The yarn of Example 1 was coated with an insulation layer of polyethylene. The polyethylene was Tenite 812A from Eastman Chemicals. The polyethylene was extruded onto the yarn at a temperature of about 230° F. at a pressure of about 800 psi, and was water quenched at a temperature of about 75° F. The final diameter of the insulated yarn was about 53 mils. and had a denier of about 13,250. The resistance of the insulated yarn was about 400 Ohms/inch at about 75° F.

EXAMPLE 3

The yarn of Example 1 was coated with an insulation layer of polyethylene, the polyethylene being Dow 9551 from Dow Plastics. The polyethylene was extruded onto the yarn at a temperature of about 230° F. at a pressure of about 800 psi, and was water quenched at a temperature of about 75° F. The final diameter of the insulated yarn was about 53 mils. and had a denier of about 13,250. The resistance of the insulated yarn was about 400 Ohms/inch at about 75° F.

EXAMPLE 4

A temperature dependent electrically resistance yarn was formed from a core yarn of 500 denier multi-filament polyester with a PTCR sheath of fifty percent (50%) carbon conducting particles and fifty percent (50%) EEA. The average yarn size was about 46 mils. Prior to extruding the PTCR sheath onto the core yarn, the material for the PTCR sheath was predried at 165° F. for at least twenty four (24) hours. The yarn was formed by extrusion coating the TELC material onto the core yarn at a temperature of about 430° F. through an orifice of about 59 mils at a pressure of about 5600 psi. The coated core yarn was quenched in water at a temperature of about 70° F. The resistance of the yarn was about 250 Ohms/inch at about 72° F.

EXAMPLE 5

A temperature dependent electrically resistance yarn was formed from a core yarn of 1000 denier multi-filament Kevlar with a PTCR sheath of fifty percent (50%) carbon conducting particles and fifty percent (50%) EEA. The average yarn size was about 44 mils. Prior to extruding the PTCR sheath onto the core yarn, the material for the PTCR sheath was predried at 165° F. at least twenty four (24) hours. The yarn was formed by extrusion coating the TELC material onto the core yarn at a temperature of about 415° F. through an orifice of about 47 mils. at a pressure of about 3900 psi. The coated core yarn was quenched in water at a temperature of about 70° F. The resistance of the yarn was about 390 Ohms/inch at about 72° F.

EXAMPLE 6

A temperature dependent electrically resistance yarn was formed from a core yarn of 1000 denier multi-filament Kevlar with a PTCR sheath of fifty percent (50%) carbon conducting particles and fifty percent (50%) EEA. The average yarn size was about 32 mils. Prior to extruding the PTCR sheath onto the core yarn, the material for the PTCR sheath was predried at 165° F. at least twenty four (24) hours. The yarn was formed by extrusion coating the TELC material onto the core yarn at a temperature of about 415° F. through an orifice of about 36 mils. at a pressure of about 3700 psi. The coated core yarn was quenched in water at a temperature of about 70° F. The resistance of the yarn was about 1000 Ohms/inch at about 72° F.

Figure 2:
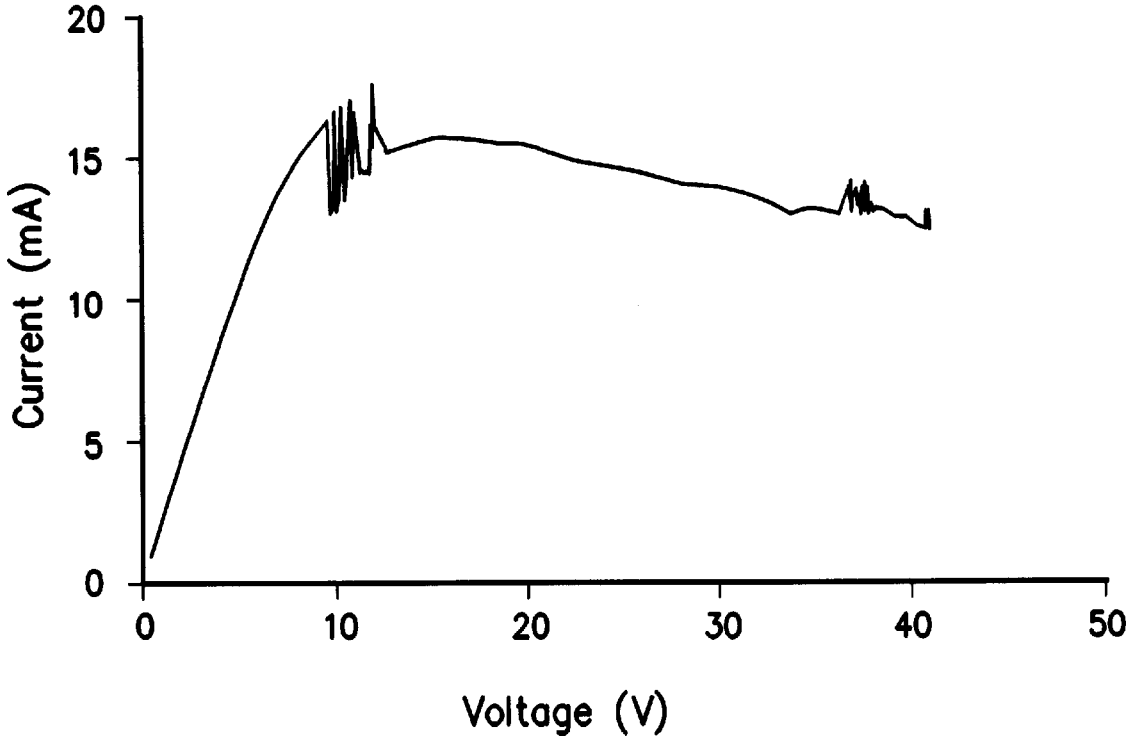
FIG. 2 shows a graph of current as a function of voltage through one inch of one embodiment of the yarn in the present invention.

Referring now to FIG. 2, there is show a graph of current as a function of voltage through one inch of the yarn from Example 1. A 4-probe resistance setup was used to apply a steadily increasing DC voltage to the yarn in ambient air. The voltage across and current through a 1-inch length of yarn was monitored and plotted in FIG. 2. FIG. 2 shows that the yarn of this invention can be used to limit the total current draw. The limitation on current draw both controls heat generation and helps prevent thermal stress to the yarn, reducing the possibility of broken heating elements. As shown the current draw for a yarn from Example 1 was limited to about 15 mA per yarn. A larger yarn would pass more current, as would a more conductive yarn. Conversely, a smaller or less conductive yarn would pass less current.

Referring now to FIG. 3, there is show a graph illustrating the different temperature dependence of the electrical resistance of a yarn made according to the present invention, and "conventional" conducting materials that might be put into a fabric. "TDER yarn" is the yarn from Example 1. "Copper wire" is a commercially available 14 gage single-strand wire. "Silver-coated nylon" is a 30 denier nylon yarn coated with silver, available from Instrument Specialties—Sauquoit of Scranton, Pa. "Stainless steel yarn" is a polyester yarn with 4 filaments of stainless steel twisted around the outside, available from Bekaert Fibre Technologies of Marietta, Ga. In FIG. 3, the Relative Resistance is the resistance of the material relative to its value at 100° F. The three conventional materials all show very small temperature coefficients, whereas the resistance of the TDER yarn changes by more than a factor of 6 at 250° F. As is typically the case for polymer-based PTCR materials, further heating will reduce the resistance. In actual use, products can be designed so they do not reach this temperature range during operation.

Table 1 below lists the temperature coefficients for each material in the range of 150° F.–200° F. From the last column we see that the TDER yarn has 50 or more times the temperature coefficient of other typically available conductive materials suitable for construction of a textile.

TABLE 1

| Material | Temperature coefficient (ohm/ohm/C) | Coefficient relative to TDER yarn |
|---|---|---|
| Copper wire: | 0.00067 | 0.0092 |
| Silver-coated nylon yarn: | −0.0012 | −0.016 |
| Stainless steel yarn: | 0.0015 | 0.021 |
| TDER yarn: | 0.073 | — |

What is claimed is:

1. An electrically conductive yarn having a temperature dependent resistance, said yarn comprising:

a flexible non-conducting core;

a sheath disposed on the flexible non-conducting core and having a positive temperature coefficient of resistance, said sheath including:

a low conductive matrix material which expands with increased temperature;

a plurality of distinct electrical conductors intermixed throughout the matrix material;

wherein the plurality of distinct electrical conductors provide an electrical conductive pathway through the sheath;

wherein the low conductive matrix material has a higher coefficient of expansion than the conductive particles; and wherein expansion of the matrix material separates various conductive particles within the sheath thereby increasing the electrical resistance of the sheath;

wherein the sheath provides the positive coefficient of resistance along the length of said yarn.

2. The electrically conductive yarn according to claim 1, wherein the resistance value of said yarn is within the range of from about 0.1 Ohms/inch to about 2500 Ohms/inch.

3. The electrically conductive yarn according to claim 1, wherein the flexible core comprises multifilaments.

4. The electrically conductive yarn according to claim 1, wherein the flexible core comprises staple fibers.

5. The electrically conductive yarn according to claim 1, wherein the flexible core comprises a synthetic material.

6. The electrically conductive yarn according to claim 1, wherein the flexible core comprise a natural fiber.

7. The electrically conductive yarn according to claim 1, wherein the flexible core comprises a spun yarn.

* * * * *